US007758656B2

(12) United States Patent
Enomoto et al.

(10) Patent No.: US 7,758,656 B2
(45) Date of Patent: Jul. 20, 2010

(54) WATER-AND-OIL REPELLENT TREATMENT OF TEXTILE

(75) Inventors: Takashi Enomoto, Settsu (JP); Ikuo Yamamoto, Settsu (JP); Norihito Otsuki, Settsu (JP); Teruyuki Fukuda, Settsu (JP); Kayo Kusumi, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/258,067

(22) PCT Filed: Apr. 16, 2001

(86) PCT No.: PCT/JP01/03217

§ 371 (c)(1),
(2), (4) Date: Oct. 18, 2002

(87) PCT Pub. No.: WO01/81672

PCT Pub. Date: Nov. 1, 2001

(65) Prior Publication Data

US 2003/0115678 A1 Jun. 26, 2003

(30) Foreign Application Priority Data

Apr. 20, 2000 (JP) ..... 2000-119603
Jan. 31, 2001 (JP) ..... 2001-023917

(51) Int. Cl.
*D06M 15/00* (2006.01)
*B05D 7/00* (2006.01)

(52) U.S. Cl. ..... 8/115.6; 8/115.51; 8/115.56; 8/115.64; 8/115.7; 252/8.61; 252/8.62; 427/315; 427/377; 427/384; 427/430.1; 442/79; 442/82; 442/83

(58) Field of Classification Search ..... 8/115.64, 8/115.15, 115.54, 115.51, 115.56, 115.6, 8/115.7; 425/95; 427/393.4, 315, 377, 384, 427/430.1; 252/8.62, 8.61; 525/200, 502; 106/287.12; 442/79, 82, 83
See application file for complete search history.

(56) References Cited

U.S. PATENT DOCUMENTS 3,401,052 A * 9/1968 Berger et al. ..... 427/242
3,585,169 A * 6/1971 Domba et al. ..... 526/248
3,655,732 A * 4/1972 Rondestvedt et al. ..... 560/222
3,824,126 A * 7/1974 Katsushima ..... 43/25
5,061,763 A * 10/1991 Moss et al. ..... 525/502
5,073,442 A 12/1991 Knowlton et al.
5,516,337 A * 5/1996 Nguyen ..... 8/557
5,520,962 A * 5/1996 Jones, Jr. ..... 427/393.4
5,759,431 A * 6/1998 Nguyen ..... 252/8.62
5,851,595 A * 12/1998 Jones, Jr. ..... 427/393.4
5,888,290 A * 3/1999 Engle et al. ..... 106/287.12
6,048,941 A * 4/2000 Yamana et al. ..... 525/200
6,197,378 B1 * 3/2001 Clark et al. ..... 427/315
6,472,019 B1 * 10/2002 Yamaguchi et al. ..... 427/354
2003/0051294 A1 * 3/2003 Yamaguchi et al. ..... 8/115.51

FOREIGN PATENT DOCUMENTS

JP 62-85080 4/1987
WO WO 98/50619 11/1998

OTHER PUBLICATIONS

International Search Report for PCT/JP01/03217 dated Jul. 10, 2001.
Notification of Transmittal of Translation of the International Preliminary Examination Report with English Translation of the International Preliminary Examination Report for PCT/JP01/03217 dated Mar. 3, 2003.

* cited by examiner

*Primary Examiner*—Lorna M Douyon
*Assistant Examiner*—Tri V Nguyen
(74) *Attorney, Agent, or Firm*—Sughrue Mion, PLLC

(57) ABSTRACT

A textile having excellent water- and oil-repellency can be obtained by a method of preparing a treated textile, having steps of: (1) preparing a treatment liquid comprising a water- and oil-repellent agent, (2) adjusting pH of the treatment liquid to at most 7, preferably at most 3, (3) applying the treatment liquid to a textile, (4) treating the textile with steam, and (5) washing the textile with water and dehydrating the textile, wherein the water- and oil-repellent agent is at least one fluorine-containing compound selected from the group consisting of a fluorine-containing polymer and a fluorine-containing low molecular weight compound, and the water- and oil-repellent agent or the treatment liquid contains an organic salt.

11 Claims, No Drawings

WATER-AND-OIL REPELLENT TREATMENT OF TEXTILE

FIELD OF THE INVENTION

The present invention relates to a treatment for imparting excellent water repellency and oil repellency to a textile. A method of the present invention is particularly useful for a carpet.

BACKGROUND OF THE INVENTION

Hitherto, various treatment methods have been proposed in order to impart water repellency, oil repellency and soil releasability to a textile such as a carpet. For example, a process (hereinafter, sometimes referred to as "Exhaust process") of treating a textile comprising decreasing a pH of a treatment liquid, applying the treatment liquid to the textile, thermally treating the textile with steam, washing the textile with water, and dehydrating the textile is proposed.

A method comprising the Exhaust process is proposed in U.S. Pat. Nos. 5,073,442, 5,520,962 and 5,516,337 and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. No. 5,520,962 discloses a method of treating a carpet, comprising conducting an Exhaust process by using a fluorine-containing compound and a polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt.

When these methods are used to conduct the Exhaust process, sufficient water-repellency, oil-repellency and soil releasability have not been obtained.

SUMMARY OF THE INVENTION

An object of the present invention is to give a textile excellent in water repellency and oil repellency, when an Exhaust process is used.

The present invention provides a method of preparing a treated textile, comprising steps of:

(1) preparing a treatment liquid comprising a water- and oil-repellent agent, (2) adjusting pH of the treatment liquid to at most 7, (3) applying the treatment liquid to a textile, (4) treating the textile with steam, and (5) washing the textile with water and dehydrating the textile, wherein the water- and oil-repellent agent comprises at least one fluorine-containing compound selected from the group consisting of a fluorine-containing polymer and a fluorine-containing low molecular weight compound, and the water- and oil-repellent agent or the treatment liquid contains an organic salt.

The present invention also provides a textile prepared by the above-mentioned method and a water- and oil-repellent agent used in the above-mentioned method.

DETAILED DESCRIPTION OF THE INVENTION

The procedure used in the present invention is an Exhaust process which comprises decreasing pH of a treatment liquid comprising a fluorine-containing compound, applying a treatment liquid to a textile, thermally treating the textile, washing the textile with water, and dehydrating the textile.

In the step (1) of the method of the present invention, the treatment liquid comprising the water- and oil-repellent agent, which is applied to the textile, is prepared. The treatment liquid comprising the water- and oil-repellent agent may be in the form of a solution or an emulsion, particularly an aqueous emulsion. The water- and oil-repellent agent before the preparation of the treatment liquid may contain the organic salt, or the treatment liquid may be prepared by adding the organic salt to the water- and oil-repellent agent.

The organic salt is generally a metal salt of an organic acid.

Examples of the organic acid include a carboxylic acid having a —COOH group, a sulfonic acid having a —$SO_3H$ group and a sulfate monoester having a —$OSO_3H$ group in molecule.

Examples of the carboxylic acid include formic acid, acetic acid, oxalic acid, phthalic acid, citric acid, propionic acid and butyric acid. Examples of the sulfonic acid include taurine, taurine derivatives (e.g., N-cocoylmethyltaurine) and alkylsulfonic acid (The carbon number of an alkyl group may be, for example, from 1 to 30, particularly from 5 to 20. )(e.g., tetradecenesulfonic acid). Examples of sulfate monoester include monoalkyl sulfate (The carbon number of an alkyl group may be, for example, from 1 to 30, particularly from 5 to 20.), polyoxyalkylenealkylether sulfate (The carbon number of an oxyalkylene group may be 2 or 3, and the carbon number of an alkyl group may be, for example, from 1 to 30, particularly from 5 to 20.). Specific examples of the sulfate monoester include lauryl sulfate and polyoxyethylenelaurylether sulfate.

A metal in the metal salt of organic acid is a mono-to tetra-valent, particularly mono- to tri-valent metal. Examples of the metal include an alkaline metal (e.g., potassium and sodium), an alkaline earth metal (e.g., calcium) and aluminum.

The amount of the metal salt of organic acid is, for example, from 0.1 to 1,000 parts by weight, particularly from 10 to 500 parts by weight, per 1 part by weight (solid content) of the fluorine-containing compound.

In the step (2) in the method of the present invention, pH of the treatment liquid is brought to at most 7. pH of the treatment liquid is preferably at most 3, more preferably at most 2. pH can be decreased by addition of an acid such as an aqueous solution of citraconic acid and an aqueous solution of sulfamic acid to the treatment liquid.

In the step (3) of the method of the present invention, the treatment liquid is applied to the textile. The water-and oil-repellent agent can be applied to a substrate to be treated (that is, the textile) by a know procedure. The application of the treatment liquid can be conducted by immersion, spraying and coating. Usually, the treatment liquid is diluted with an organic solvent or water, and is adhered to surfaces of the substrate by a well-known procedure such as an immersion coating, a spray coating and a foam coating to a fabric (for example, a carpet cloth), a yarn (for example, a carpet yarn) or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid. The concentration of the water- and oil-repellent agent active component (that is, the fluorine-containing compound) in the treatment liquid contacted with the substrate may be from 0.05 to 10% by weight, based on the treatment liquid. A stain blocking agent may used in the amount of, for example, 0 to 1,000 parts by weight, particularly 1 to 500 parts by weight, in terms of solid, per 100 parts by weight of the fluorine-containing compound.

In the step (4) of the method of the present invention, the textile is thermally treated. The thermal treatment can be conducted by applying a steam (for example, 90 to 110° C.) to the textile under a normal pressure for e.g., 10 seconds to 10 minutes.

In the step (5) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure.

After the step (5), the textile can be dried.

The fluorine-containing compound is a fluorine-containing polymer and/or a fluorine-containing low molecular weight compound.

The fluorine-containing polymer may be a polymer comprising a repeat unit derived from a fluoroalkyl group-containing monomer such as a fluoroalkyl group-containing (meth)acrylate, a fluoroalkyl group-containing maleate or fumarate, or a fluoroalkyl group-containing urethane.

The fluoroalkyl group-containing (meth)acrylate ester may be of the formula:

$$\text{Rf-A-OCOCR}^{11}{=}\text{CH}_2$$

wherein Rf is a fluoroalkyl group having 3 to 21 carbon atoms, $R^{11}$ is a hydrogen atom or a methyl group, and A is a divalent organic group.

In the above formula, A may be a linear or branched alkylene group having 1 to 20 carbon atoms, a $—SO_2N(R^{21})R^{22}—$group or a $—CH_2CH(OR^{23})CH_2—$ group ($R^{21}$ is an alkyl group having 1 to 10 carbon atoms, $R^{22}$ is a linear or branched alkylene group having 1 to 10 carbon atoms, and $R^{23}$ is a hydrogen atom or an acyl group having 1 to 10 carbon atoms).

Examples of the fluoroalkyl group-containing (meth)acrylate are as follows:

$$\text{Rf}—\text{SO}_2—\text{N}(\text{R}^1)\text{R}^2\text{OCOCR}^3{=}\text{CH}_2 \quad (1)$$

$$\text{Rf-(CH}_2)_n\text{OCOCR}^3{=}\text{CH}_2 \quad (2)$$

$$\text{Rf}—\text{CON}(\text{R}^1)\text{R}^2\text{OCOCR}^3{=}\text{CH}_2 \quad (3)$$

$$\text{Rf}—\text{CH}_2\text{CH(OH)CH}_2\text{OCOCR}^3{=}\text{CH}_2 \quad (4)$$

$$\text{Rf}—\text{CH}_2\text{CH(OCOR}^3\text{)CH}_2\text{OCOCR}^3{=}\text{CH}_2 \quad (5)$$

$$\text{Rf-O-Ar-CH}_2\text{OCOCR}^3{=}\text{CH}_2 \quad (6)$$

wherein Rf is a fluoroalkyl group having 3 to 21 carbon atoms, $R^1$ is a hydrogen atom or an alkyl group having 1 to 10 carbon atoms, $R^2$ is an alkylene group having 1 to 10 carbon atoms, $R^3$ is a hydrogen atom or a methyl group, and Ar is arylene group optionally having a substituent, and n is an integer of 1 to 10.

Specific examples of the fluoroalkyl group-containing (meth)acrylate are as follows:

$CF_3(CF_2)_7(CH_2)_{10}OCOCH{=}CH_2$
$CF_3(CF_2)_7(CH_2)_{10}OCOC(CH_3){=}CH_2$
$CF_3(CF_2)_6CH_2OCOCH{=}CH_2$
$CF_3(CF_2)_8CH_2OCOC(CH_3){=}CH_2$
$(CF_3)_2CF(CF_2)_6(CH_2)_2OCOCH{=}CH_2$
$(CF_3)_2CF(CF_2)_8(CH_2)_2OCOCH{=}CH_2$
$(CF_3)_2CF(CF_2)_{10}(CH_2)_2OCOCH{=}CH_2$
$(CF_3)_2CF(CF_2)_6(CH_2)_2OCOC(CH_3){=}CH_2$
$(CF_3)_2CF(CF_2)_8(CH_2)_2OCOC(CH_3){=}CH_2$
$(CF_3)_2CF(CF_2)_{10}(CH_2)_2OCOC(CH_3){=}CH_2$
$CF_3CF_2(CF_2)_6(CH_2)_2OCOCH{=}CH_2$
$CF_3CF_2(CF_2)_8(CH_2)_2OCOCH{=}CH_2$
$CF_3CF_2(CF_2)_{10}(CH_2)_2OCOCH{=}CH_2$
$CF_3CF_2(CF_2)_6(CH_2)_2OCOC(CH_3){=}CH_2$
$CF_3CF_2(CF_2)_8(CH_2)_2OCOC(CH_3){=}CH_2$
$CF_3CF_2(CF_2)_{10}(CH_2)_2OCOC(CH_3){=}CH_2$
$CF_3(CF_2)_7SO_2N(CH_3)(CH_2)_2OCOCH{=}CH_2$
$CF_3(CF_2)_7SO_2N(C_2H_5)(CH_2)_2OCOCH{=}CH_2$
$(CF_3)_2CF(CF_2)_8CH_2CH(OCOCH_3)CH_2OCOC(CH_3){=}CH_2$
$(CF_3)_2CF(CF_2)_6CH_2CH(OH)CH_2OCOCH{=}CH_2$

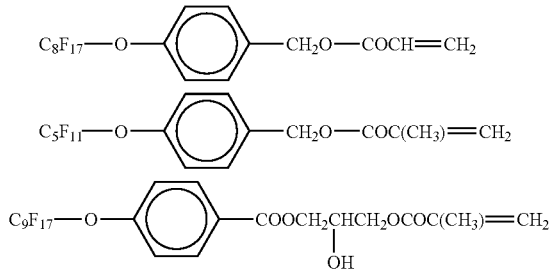

A fluoroalkyl group-containing urethane monomer deriving the fluorine-containing polymer can be prepared by reacting:

(a) a compound having at least two isocyanate groups, (b) a compound having one carbon-carbon double bond and at least one hydroxyl group or amino group, and (c) a fluorine-containing compound one hydroxyl group or amino group.

Examples of the compound (a) include the followings:

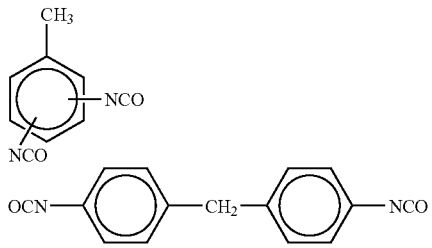

-continued

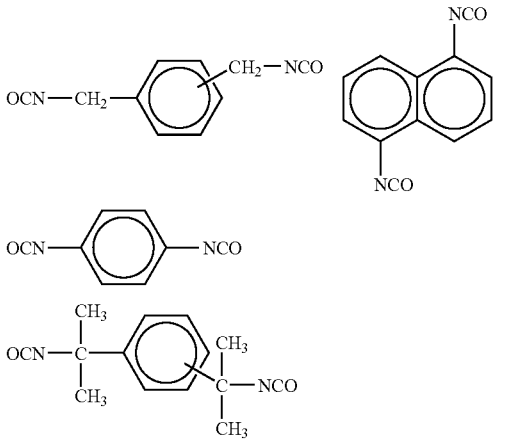

$OCN(CH_2)_6NCO$

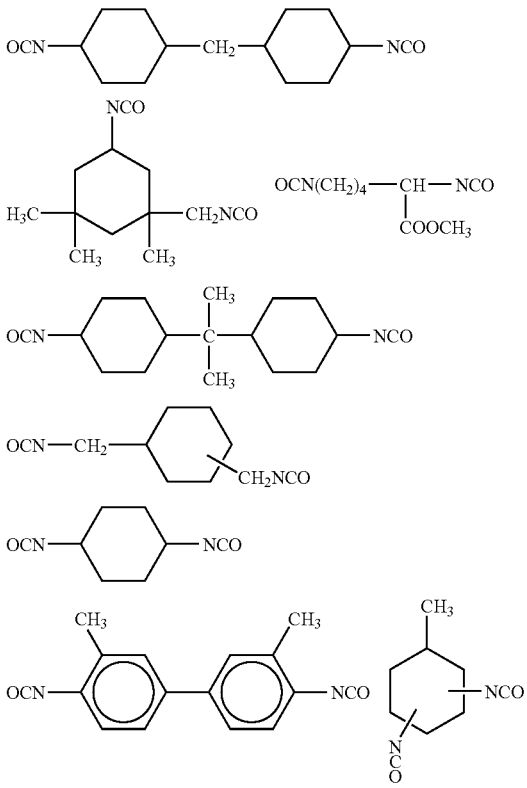

The compound (a) is preferably a diisocyanate. However, a triisocyanate and a polyisocyanate can be also used for the reaction.

For example, a trimer of diisocyanate, polymeric MDI (diphenylmethane diisocyanate) and an adduct of diisocyanate with a polyhydric alcohol such as trimethylol propane, trimethylol ethane and glycerol can be also used for the reaction.

Examples of the triisocyanate and the polyisocyanate are as follows:

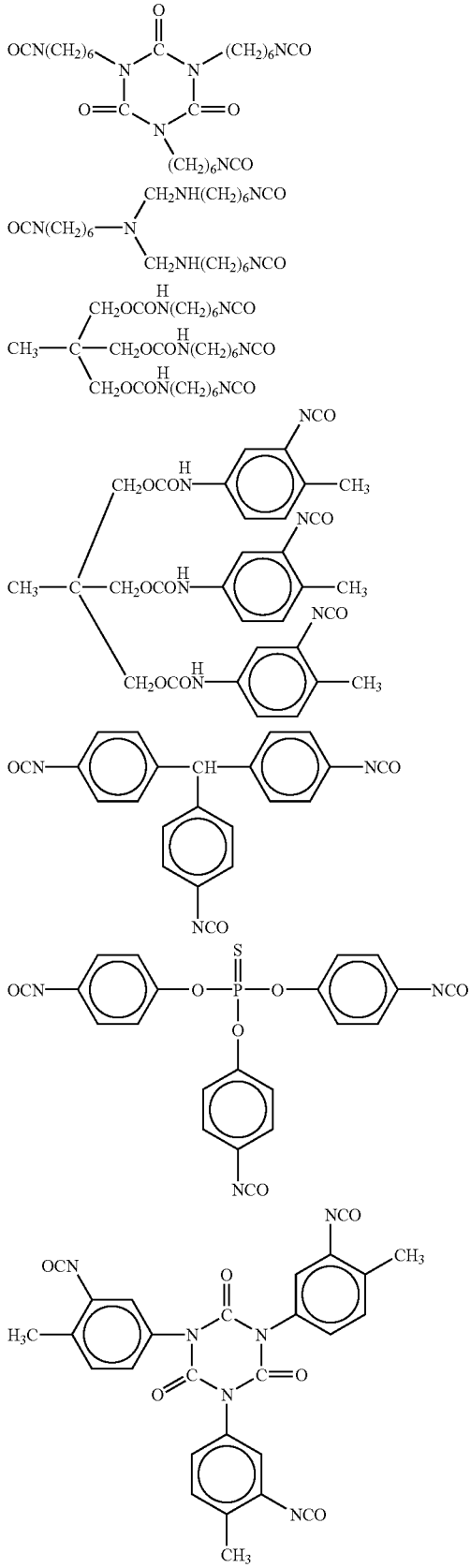

The compound (b) may be, for example, a compound of each of the formulas:

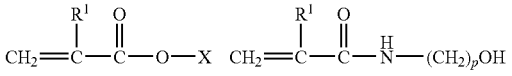

$CH_2{=}CH{-}CH_2{-}OH$ $CH_2{=}CH{-}CH_2{-}NH_2$

In the formula, $R^1$ is a hydrogen atom or a methyl group. X is as follows:

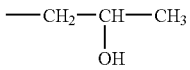

$-(CH_2)_pOH$

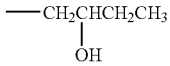

$-(CH_2CH_2O)_nH$

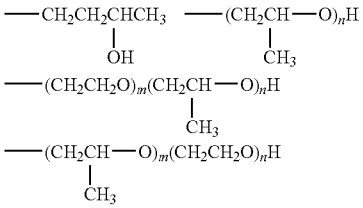

$-(CH_2CH_2O)_m(CH_2CH_2CH_2CH_2O)_nH$ $-(CH_2CH_2CH_2CH_2O)_m(CH_2CH_2O)_nH$

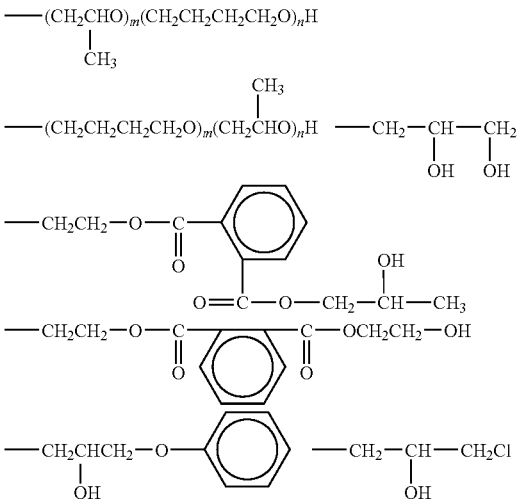

wherein m and n is a number of 1 to 300.

The compound (c) may be a compound of the formula:

$R_f{-}R^2{-}OH$, or $R_f{-}R^2{-}NH_2$ wherein $R_f$ is a fluoroalkyl group having 1 to 22 carbon atoms, and $R^2$ is an alkylene group having 1 to 10 carbon atoms and may have a heteroatom.

Examples of the compound (c) may be the followings:

$CF_3CH_{2OH}$ $F(CF_2)_8CH_2CH_2OH$ $F(CF_2)_6(CH_2)_6OH$

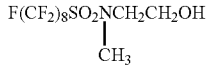

$F(CF_2)_3CH_2NH_2$ $F(CF_2)_7CH_2NH_2$

The compounds (a), (b) and (c) may be reacted such that when the compound (a) is a diisocyanate, both the compounds (b) and (c) are in amounts of 1 mol based on 1 mol of the compound (a); when the compound (a) is a triisocyanate, the compound (b) is in an amount of 1 mol and the compound (c) is in an amount of 2 mol based on 1 mol of the compound (a).

The fluorine-containing polymer constituting the water- and oil-repellent agent may comprise:

(I) a repeat unit derived from a monomer having a fluoroalkyl group, and (II) a repeat unit derived from a fluorine-free monomer.

The fluorine-containing polymer constituting the water- and oil-repellent agent may comprise:

(I) a repeat unit derived from a monomer having a fluoroalkyl group, (II) a repeat unit derived from a fluorine-free monomer, and (III) a repeat unit derived from a crosslinkable monomer.

Examples of the monomer having fluoroalkyl group constituting the repeat unit (I) include the same as the above-mentioned fluoroalkyl group-containing monomer such as a fluoroalkyl group-containing (meth)acrylate.

The repeat unit (II) is preferably derived from a fluorine-free olefinically unsaturated monomer. Non-limiting examples of a preferable monomer constituting the repeat unit (II) include, for example, ethylene, vinyl acetate, vinyl chloride such as vinyl chloride, vinylidene halide such as vinylidene chloride, acrylonitrile, styrene, polyethyleneglycol (meth)acrylate, polypropyleneglycol (meth)acrylate, methoxypolyethyleneglycol (meth)acrylate, methoxypolypropyleneglycol (meth)acrylate, vinyl alkyl ether and isoprene.

The monomer constituting the repeat unit (II) may be a (meth)acrylate ester having an alkyl group. The number of carbon atoms of the alkyl group may be from 1 to 30, for example, from 6 to 30, e.g., from 10 to 30. For example, the monomer constituting the repeat unit (II) may be acrylates of the general formula:

$CH_2{=}CA^3COOA^4$ wherein $A^3$ is a hydrogen atom or a methyl group, and $A^4$ is an alkyl group represented by $C_nH_{2n+1}$ (n=1 to 30). The copolymerization with this monomer can optionally improve various properties such as water- and oil-repellency and soil releasability; cleaning durability, washing durability and abrasion resistance of said repellency and releasability; solubility in solvent; hardness; and feeling.

The crosslinkable monomer constituting the repeat unit (III) may be a fluorine-free vinyl monomer having at least two reactive groups. The crosslinkable monomer may be a compound having at least two carbon-carbon double bonds, or a compound having at least one carbon-carbon double bond and at least one reactive group.

Examples of the crosslinkable monomer include diacetoneacrylamide, (meth)acrylamide, N-methylolacrylamide, hydroxymethyl (meth)acrylate, hydroxyethyl (meth)acrylate, 3-chloro-2-hydroxypropyl (meth)acrylate, N,N-dimethylaminoethyl (meth)acrylate, N,N-diethylaminoethyl (meth)acrylate, butadiene, chloroprene and glycidyl (meth) acrylate, to which the crosslinkable monomer is not limited. The copolymerization with this monomer can optionally improve various properties such as water-repellency and soil releasability; cleaning durability and washing durability of said repellency and releasability; solubility in solvent; hardness; and feeling.

The fluorine-containing polymer preferably has a weight average molecular weight of 2,000 to 1,000,000.

Preferably, the amount of the repeat unit (I) is from 40 to 90% by weight, more preferably from 50 to 80% by weight, the amount of the repeat unit (II) is from 5 to 60% by weight, more preferably from 10 to 40% by weight, and the amount of the repeat unit (III) is from 0 to 10% by weight, more preferably 0.1 to 10% by weight, for example 0.5 to 10% by weight, based on the fluorine-containing polymer.

The fluorine-containing polymer in the present invention can be produced by any polymerization method, and the conditions of the polymerization reaction can be arbitrary selected. The polymerization method includes, for example, solution polymerization and emulsion polymerization. Among them, the emulsion polymerization is particularly preferred.

In the solution polymerization, there can be used a method of dissolving the monomers in an organic solvent in the presence of a polymerization initiator, replacing the atmosphere by nitrogen, charging vinyl chloride and/or vinylidene chloride (A-II) and stirring the mixture with heating at the temperature within the range, for example, from 50° C. to 120° C. for 1 hour to 10 hours. Examples of the polymerization initiator include azobisisobutyronitrile, benzoyl peroxide, di-tert-butyl peroxide, lauryl peroxide, cumene hydroperoxide, t-butyl peroxypivalate and diisopropyl peroxydicarbonate. The polymerization initiator is used in the amount within the range from 0.01 to 5 parts by weight based on 100 parts by weight of the monomers.

The organic solvent is inert to the monomer and dissolves them, and examples thereof include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of whole of the monomers.

In the emulsion polymerization, there can be used a method of emulsifying the monomers in water in the presence of a polymerization initiator and an emulsifying agent, replacing the atmosphere by nitrogen, charging vinyl chloride and/or vinylidene chloride (A-II) and copolymerizing with stirring at the temperature within the range, for example, from 50° C. to 80° C. for 1 hour to 10 hours. As the polymerization initiator, for example, water-soluble initiators (e.g., benzoyl peroxide, lauroyl peroxide, t-butyl perbenzoate, 1-hydroxycyclohexyl hydroperoxide, 3-carboxypropionyl peroxide, acetyl peroxide, azobisisobutylamidine dihydrochloride, azobisisobutyronitrile, sodium peroxide, potassium persulfate and ammonium persulfate) and oil-soluble initiators (e.g., azobisisobutyronitrile, benzoyl peroxide, di-tert-butyl peroxide, lauryl peroxide, cumene hydroperoxide, t-butyl peroxypivalate and diisopropyl peroxydicarbonate) are used. The polymerization initiator may be used in the amount within the range from 0.01 to 5 parts by weight based on 100 parts by weight of the monomers.

In order to obtain a copolymer dispersion in water, which is superior in storage stability, it is desirable that the monomers are atomized in water by using an emulsifying device capable of applying a strong shattering energy (e.g., a high-pressure homogenizer and an ultrasonic homogenizer) and then polymerized with using the oil-soluble polymerization initiator. As the emulsifying agent, various emulsifying agents such as an anionic emulsifying agent, a cationic emulsifying agent and a nonionic emulsifying agent can be used in the amount within the range from 0.5 to 10 parts by weight based on 100 parts by weight of the monomers. When the monomers are not completely compatibilized, a compatibilizing agent capable of sufficiently compatibilizing them (e.g., a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol and ethanol. The water-soluble organic solvent may be used in the amount within the range from 1 to 50 parts by weight, e.g., from 10 to 40 parts by weight, based on 100 parts by weight of water.

The fluorine-containing low molecular weight compound may have a molecular weight of less than 2,000, for example, from 500 to 1,500 and may be a fluoroalkyl group-containing compound.

The fluorine-containing low molecular weight compound may be, for example, a fluoroalkyl group-containing urethane or a fluoroalkyl group-containing ester.

The fluoroalkyl group-containing urethane can be prepared by reacting (i) a compound having at least two isocyanate groups, with (ii) a fluorine-containing compound having one hydroxyl group, amino group or epoxy group.

Examples of the compound having at least two isocyanate groups (i) are the same as those of the above-mentioned compound having at least two isocyanate groups (a) used for the fluoroalkyl group-containing urethane monomer deriving the fluorine-containing copolymer.

Specific examples of the fluorine-containing compound having one hydroxyl group, amino group or epoxy group (ii) are as follows:

$CF_3CF_2(CF_2CF_2)_nCH_2CH_2OH$ $CF_3CF_2(CF_2CF_2)_nCH_2CH_2NH_2$

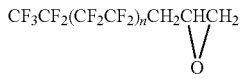

[n is from 2 to 8]

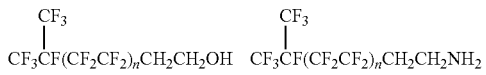

-continued

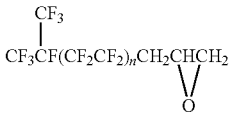

[n is from 2 to 8]

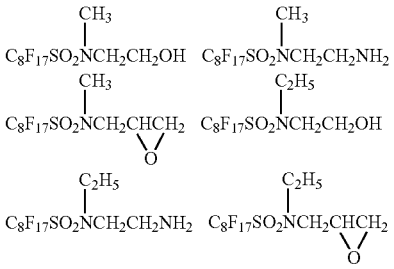

The fluoroalkyl group-containing ester can be prepared by reacting:

(iii) a polybasic carboxylic acid compound, with (ii) a fluorine-containing compound having one hydroxyl group, amino group or epoxy group.

The polybasic carboxylic acid compound is a compound having at least 2, preferably 2 to 4 carboxylic acid groups.

Specific examples of the polybasic carboxylic acid compound are as follows:

$HOOC(CH_2)_nCOOH$

[n is 2, 4 or 6]

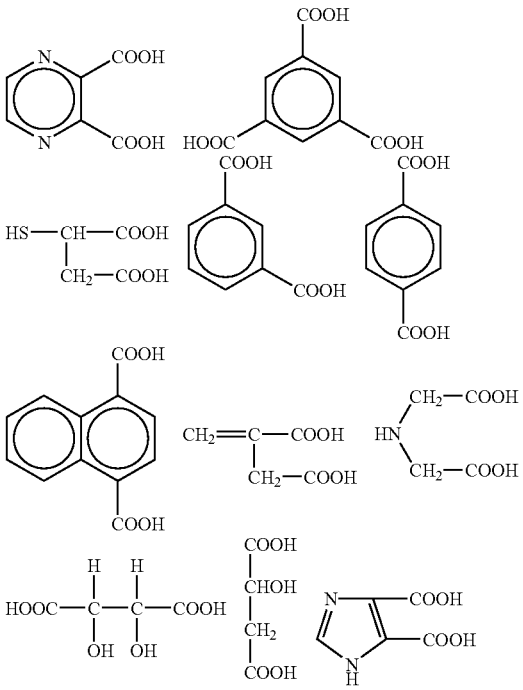

Examples of the fluorine-containing compound having one hydroxyl group, amino group or epoxy group (ii) forming the fluoroalkyl group-containing ester are the same as those of the above-mentioned fluorine-containing compound having one hydroxyl group, amino group or epoxy group (ii) forming the fluoroalkyl group-containing urethane.

The fluorine-containing compound may be the fluorine-containing polymer, the fluorine-containing low molecular weight compound, or a mixture of the fluorine-containing polymer and the fluorine-containing low molecular weight compound.

The amount of the fluorine-containing compound is at most 60% by weight, preferably from 1 to 40% by weight, for example, 1 to 30% by weight, based on the water- and oil-repellent agent. The amount of the emulsifier may be from 0.5 to 15 parts by weight, based on 100 parts by weight of the fluorine-containing compound.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The method of the present invention can be suitably used in carpets made of nylon fibers, polypropylene fibers and/or polyester fibers, because the present invention provides excellent resistance to a detergent solution and brushing (mechanical).

The textile may be in any form such as a fiber and a fabric. When the carpet is treated according to the method of the present invention, the carpet may be formed after the fibers or yarns are treated according to the present invention, or the formed carpet may be treated according to the present invention. The water- and oil-repellent agent can be used in the state that the fluorine-containing compound is diluted to the content of 0.02 to 30% by weight, preferably 0.02 to 10% by weight.

PREFERRED EMBODIMENTS OF THE INVENTION

The following Examples further illustrate the present invention but are not to be construed to limit the scope thereof. The water repellency and oil repellency of the carpets obtained in the Examples and Comparative Example were evaluated.

Test procedures of the water repellency and the oil repellency are as follows.

(1) Water Repellency

A droplet of a isopropyl alcohol (IPA)/water mixture liquid shown in Table 1 is softly positioned on a carpet surface, and a maximum content of IPA (% by volume) in the liquid which maintains the droplet shape is taken as the result of the water repellency.

The specific procedure is as follows.

A carpet treated for giving repellency is stored in a thermo-hygrostat having a temperature of 21° C. and a humidity of 65% for at least 4 hours. A test liquid (having the composition shown in Table 1) has been also stored at 21° C. The temperature of a measurement room is controlled to be about 21° C. Droplets of the test liquid in an amount of 50 μL are softly dropped by a micropipette on the carpet and the diameter of the droplets is 5 mm. The micropippete is vertically stood and droplets are softly dropped. Five droplets are positioned. If 4 or 5 droplets remain on the carpet after standing for 10 seconds, it is evaluated that the test liquid passes the test. The maximum content of IPA (% by volume) in the test liquid which passes the test is taken as the result of the water repellency.

TABLE 1

| Mixing composition (% by volume) | |
|---|---|
| Isopropyl alcohol | Water |
| 100 | 0 |
| 90 | 10 |
| 80 | 20 |
| 70 | 30 |
| 60 | 40 |
| 50 | 50 |
| 40 | 60 |
| 30 | 70 |
| 25 | 75 |
| 20 | 80 |
| 15 | 85 |
| 10 | 90 |
| 5 | 95 |
| 2 | 98 |
| 0 | 100 |
| Fail | Inferior to IPA 0%/water 100% |

(2) Oil Repellency

The oil repellency is evaluated as follows.

A carpet treated for giving repellency is stored in a thermo-hygrostat having a temperature of 21° C. and a humidity of 65% for at least 4 hours. A test liquid (having the composition shown in Table 2) has been also stored at 21° C. The temperature of a measurement room is controlled to be about 21° C. Droplets of the test liquid in an amount of 50 μL are softly dropped by a micropipette on the carpet and the diameter of the droplets is 5 mm. The micropippete is vertically stood and droplets are softly dropped. Five droplets are positioned. If 4 or 5 droplets remain on the carpet after standing for 10 seconds, it is evaluated that the test liquid passes the test. The maximum point of the test liquid which passes the test is taken as the result of the oil repellency.

TABLE 2

| Oil repellency | Test solution | Surface tension (dyne/cm, 25° C.) |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Mixture solution of n-hexadecane 35/Nujol 65 | 29.6 |
| 1 | Nujol | 31.2 |
| 0 | Inferior to 1 | — |

PREPARATIVE EXAMPLE 1

200 g of perfluoroalkyl acrylate: $CH_2{=}CH{-}COOCH_2CH_2{-}Rf$ (a mixture wherein a molar ratio of Rf=$C_6F_{13}$, $C_8F_{17}$, $C_{10}F_{21}$, $C_{12}F_{25}$ and $C_{14}F_{29}$ was 2:40:30:15:3, an average molecular weight of 528) and 15 g of stearyl acrylate were sufficiently mixed, and then 20 g of polyoxyethylene(n=15)octylphenyl ether (a nonionic emulsifier), 10 g of sodium lauryl sulfate (an anionic emulsifier), 0.15 g of lauryl mercaptan, 70 g of tripropylene glycol and 450 g of deionized water were added and the mixture was emulsified by a high pressure homogenizer. The resultant emulsion was charged into a 1 L autoclave, and the atmosphere in the autoclave was replaced with nitrogen. 70 g of vinyl chloride was injected and a solution of an initiator, ammonium persulfate (1.5 g) in water (10 g) was added. The temperature was increased to 60° C. to initiate the polymerization. The mixture was stirred at 60° C. for 6 hours to give an aqueous emulsion of a copolymer. The composition of monomers in the resultant copolymer was almost the same as the charged monomer composition.

Comparative Example 1

0.4 g of the emulsion prepared in Preparative Example 1 and 5 g of a stain blocking agent (FX-657, manufactured by 3M) were diluted with water to give the total amount of 1,000 g. A 10% aqueous sulfamic acid solution was added to the emulsion so that pH of the emulsion was 1.5, to give a treatment liquid.

A carpet (8.9 cm×18.2 cm, nylon-6, cut pile, density: 36 oz/yd$^2$) was immersed in this treatment liquid for 30 seconds and squeezed to have a WPU (wet pick up) amount of 300%. Then, a normal-pressure steamer treatment (temperature: 100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes. Then, the evaluation of water repellency and oil repellency was conducted. The results are shown in Table A.

Comparative Example 2

0.4 g of the emulsion prepared in Preparative Example 1, 5 g of a stain blocking agent (FX-657, manufactured by 3M) and a metal salt, $MgSO_4$ (OWG (on the weight of goods) was 1, 2, 4 and 8) were diluted with water to give the total amount of 1,000 g. A 10% aqueous sulfamic acid solution was added to the emulsion so that pH of the emulsion was 1.5, to give a treatment liquid (The normalities of the treatment liquids were 0.055 N, 0.11 N, 0.22 N and 0.44 N, respectively.).

A carpet (8.9 cm×18.2 cm, nylon-6, cut pile, density: 36 oz/yd$^2$) was immersed in this treatment liquid for 30 seconds and squeezed to have a WPU (wet pick up) amount of 300%. Then, a normal-pressure steamer treatment (temperature: 100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes. Then, the evaluation of water repellency and oil repellency was conducted. The results are shown in Table A.

Examples 1 to 3

0.4 g of the emulsion prepared in Preparative Example 1, 5 g of a stain blocking agent (FX-657, manufactured by 3M) and an organic salt shown in Table A (Example 1: potassium formate, Example 2: potassium oxalate, Example 3: potassium phthalate) (added so that a resultant treatment liquid had the normality of 0.055 N, 0.11 N, 0.22 N or 0.44 N) were diluted with water to give the total amount of 1,000 g. A 10% aqueous sulfamic acid solution was added to the emulsion so that pH of the emulsion was 1.5, to give a treatment liquid.

A carpet (8.9 cm×18.2 cm, nylon-6, cut pile, density: 36 oz/yd$^2$) was immersed in this treatment liquid for 30 seconds and squeezed to have a WPU (wet pick up) amount of 300%. Then, a normal-pressure steamer treatment (temperature:

100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes. Then, the evaluation of water repellency and oil repellency was conducted. The results are shown in Table A.

TABLE A

| Fluorine-containing polymer | Stain blocking agent | Salt added | Normality (N) | Water repellency | Oil repellency |
|---|---|---|---|---|---|
| Com. Ex. 1 | | | | | |
| Pre. Ex. 1 | FX-657 | No addition | — | 25 | 0 |
| Com. Ex. 2 | | | | | |
| Pre. Ex. 1 | FX-657 | $MgSO_4$ (OWG = 1) | 0.055 | 25 | 1 |
| Pre. Ex. 1 | FX-657 | $MgSO_4$ (OWG = 2) | 0.11 | 20 | 1 |
| Pre. Ex. 1 | FX-657 | $MgSO_4$ (OWG = 4) | 0.22 | 25 | 2 |
| Pre. Ex. 1 | FX-657 | $MgSO_4$ (OWG = 8) | 0.44 | 30 | 2 |
| Ex. 1 | | | | | |
| Pre. Ex. 1 | FX-657 | Potassium formate | 0.055 | 25 | 2 |
| Pre. Ex. 1 | FX-657 | Potassium formate | 0.11 | 30 | 2 |
| Pre. Ex. 1 | FX-657 | Potassium formate | 0.22 | 90 | 4 |
| Pre. Ex. 1 | FX-657 | Potassium formate | 0.44 | 80 | 5 |
| Ex. 2 | | | | | |
| Pre. Ex. 1 | FX-657 | Potassium oxalate | 0.055 | 25 | 1 |
| Pre. Ex. 1 | FX-657 | Potassium oxalate | 0.11 | 30 | 1 |
| Pre. Ex. 1 | FX-657 | Potassium oxalate | 0.22 | 80 | 4 |
| Pre. Ex. 1 | FX-657 | Potassium oxalate | 0.44 | 80 | 5 |
| Ex. 3 | | | | | |
| Pre. Ex. 1 | FX-657 | Potassium phthalate | 0.055 | 25 | 1 |
| Pre. Ex. 1 | FX-657 | Potassium phthalate | 0.11 | 25 | 1 |
| Pre. Ex. 1 | FX-657 | Potassium phthalate | 0.22 | 40 | 3 |
| Pre. Ex. 1 | FX-657 | Potassium phthalate | 0.44 | 40 | 3 |

OWG: on the weight of goods

Comparative Example 3

0.4 g of the emulsion prepared in Preparative Example 1 and 5 g of a stain blocking agent (FX-657, manufactured by 3M) were diluted with water to give the total amount of 1,000 g. A 10% aqueous sulfamic acid solution was added to the emulsion so that pH of the emulsion was 2.6, to give a treatment liquid. A carpet B (8.9 cm×18.2 cm, nylon-6, cut pile, density: 32 oz/yd$^2$) was immersed in this treatment liquid for 30 seconds and squeezed to have a WPU (wet pick up) amount of 300%. Then, a normal-pressure steamer treatment (temperature: 100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes. Then, the evaluation of water repellency and oil repellency was conducted. The results are shown in Table B.

Example 4

0.4 g of the emulsion prepared in Preparative Example 1, 5 g of a stain blocking agent (FX-657, manufactured by 3M) and sodium acetate (added so that a resultant treatment liquid had the normality of 0.012 N, 0.031 N, 0.061 N, 0.091 N or 0.122 N) were diluted with water to give the total amount of 1,000 g. A 10% aqueous sulfamic acid solution was added to the emulsion so that pH of the emulsion was 2.6, to give a treatment liquid. The carpet B was treated with the treatment liquid in the same manner as in Comparative Example 3. The evaluation of water repellency and oil repellency was conducted. The results are shown in Table B.

Example 5

0.4 g of the emulsion prepared in Preparative Example 1, 5 g of a stain blocking agent (FX-657, manufactured by 3M) and sodium formate (added so that a resultant treatment liquid has the normality of 0.0147 N) were diluted with water to give the total amount of 1,000 g. A 10% aqueous sulfamic acid solution was added to the emulsion so that pH of the emulsion was 2.6, to give a treatment liquid. The carpet B was treated with the treatment liquid in the same manner as in Comparative Example 3. The evaluation of water repellency and oil repellency was conducted. The results are shown in Table B.

TABLE B

| Fluorine-containing polymer | Stain blocking agent | Added salt | Normality (N) | Water repellency | Oil repellency |
|---|---|---|---|---|---|
| Com. Ex. 3 | | | | | |
| Pre. Ex. 1 | FX-657 | 0 | 0 | Fail | 0 |
| Ex. 4 | | | | | |
| Pre. Ex. 1 | FX-657 | Sodium acetate | 0.012 | 70 | 4 |
| | | | 0.031 | 70 | 4 |
| | | | 0.061 | 70 | 5 |
| | | | 0.091 | 80 | 5 |
| | | | 0.122 | 80 | 5 |
| Ex. 5 | | | | | |
| Pre. Ex. 1 | FX-657 | Sodium formate | 0.147 | 80 | 5 |

EFFECT OF THE INVENTION

The present invention imparts excellent water-repellency and oil-repellency to a textile.

The invention claimed is:

1. A method of preparing a treated textile, comprising steps of:

(1) preparing a treatment liquid comprising a water- and oil-repellent agent, (2) adjusting pH of the treatment liquid to at most 7, (3) applying the treatment liquid to a textile, (4) subsequent to applying the treatment liquid, treating the textile with steam, and (5) washing the textile with water and dehydrating the textile, wherein the water- and oil-repellent agent comprises at least one fluorine-containing compound which is a fluorine-containing polymer, and the water- and oil-repellent agent or the treatment liquid contains an organic salt which is a monovalent metal salt of an organic acid, provided that the organic acid is at least one selected from the group consisting of formic acid, acetic acid, oxalic acid and phthalic acid when the monovalent metal is potassium, and that the organic acid is at least one selected from the group consisting of formic acid, oxalic acid and phthalic acid when the monovalent metal is sodium, and the fluorine-containing polymer consists of:

(I) a repeat unit derived from a monomer having a fluoroalkyl group, which is a (meth)acrylate ester of the formula:

$$Rf\text{-}A\text{-}OCOCR^{11}{=}CH_2$$

wherein Rf is a fluoroalkyl group having 3 to 21 carbon atoms, $R^{11}$ is a hydrogen atom or a methyl group, and A is a linear or branched alkylene group having 1 to 20 carbon atoms, a $—SO_2N(R^{21})R^{22}—$ group or a $—CH_2CH(OR^{23})CH_2—$ group where $R^{21}$ is an alkyl group having 1 to 10 carbon atoms, $R^{22}$ is a linear or branched alkylene group having 1 to 10 carbon atoms, and $R^{23}$ is a hydrogen atom or a acyl group having 1 to 10 carbon atoms, (II) a repeat unit derived from a fluorine-free monomer, and (III) optionally present, a repeat unit derived from a crosslinkable monomer which is a fluorine-free vinyl monomer having at least two reactive groups.

2. The method according to claim 1, wherein the fluorine-containing polymer comprises each of repeat units (I), (II) and (III).

3. The method according to claim 1, wherein pH of the treatment liquid is adjusted to at most 3 in the step (2).

4. The method according to claim 1, wherein the textile is a carpet.

5. The method according to claim 4, wherein the carpet comprises at least one of a nylon fiber, a polypropylene fiber and a polyester fiber.

6. A water- and oil-repellent agent for use in a method of treating a textile, said method comprising steps of:

(1) preparing a treatment liquid comprising a water- and oil-repellent agent, (2) adjusting pH of the treatment liquid to at most 7, (3) applying the treatment liquid to a textile, (4) subsequent to applying the treatment liquid, treating the textile with steam, and (5) washing the textile with water and dehydrating the textile, wherein the water- and oil-repellent agent comprises at least one fluorine-containing compound which is a fluorine-containing polymer, and the water- and oil-repellent agent or the treatment liquid contains an organic salt which is a monovalent metal salt of an organic acid, provided that the organic acid is at least one selected from the group consisting of formic acid, acetic acid, oxalic acid and phthalic acid when the monovalent metal is potassium, and that the organic acid is at least one selected from the group consisting of formic acid, oxalic acid and phthalic acid when the monovalent metal is sodium, and the fluorine-containing polymer consists of:

(I) a repeat unit derived from a monomer having a fluoroalkyl group, which is a (meth)acrylate ester of the formula:

$$Rf\text{-}A\text{-}OCOCR^{11}{=}CH_2$$

wherein Rf is a fluoroalkyl group having 3 to 21 carbon atoms, $R^{11}$ is a hydrogen atom or a methyl group, and A is a linear or branched alkylene group having 1 to 20 carbon atoms, a $—SO_2N(R^{21})R^{22}—$ group or a $—CH_2CH(OR^{23})CH_2—$ group where $R^{21}$ is an alkyl group having 1 to 10 carbon atoms, $R^{22}$ is a linear or branched alkylene group having 1 to 10 carbon atoms, and $R^{23}$ is a hydrogen atom or a acyl group having 1 to 10 carbon atoms, (II) a repeat unit derived from a fluorine-free monomer, and (III) optionally present, a repeat unit derived from a crosslinkable monomer which is a fluorine-free vinyl monomer having at least two reactive groups.

7. A water- and oil-repellent agent for use in a method of treating a textile, said method comprising steps of:

(1) preparing a treatment liquid comprising a water- and oil-repellent agent, (2) adjusting pH of the treatment liquid to at most 7, (3) applying the treatment liquid to a textile, (4) subsequent to applying the treatment liquid, treating the textile with steam, and (5) washing the textile with water and dehydrating the textile, wherein the water- and oil-repellent agent comprises at least one fluorine-containing compound which is a fluorine-containing polymer, and the water- and oil-repellent agent or the treatment liquid contains an organic salt which is a monovalent metal salt of an organic acid, provided that the organic acid is at least one selected from the group consisting of formic acid, acetic acid, oxalic acid and phthalic acid when the monovalent metal is potassium, and that the organic acid is at least one selected from the group consisting of formic acid, oxalic acid and phthalic acid when the monovalent metal is sodium, the amount of the organic salt is from 10 to 500 parts by weight, per 1 part by weight (solid content) of the fluorine-containing compound, and the fluorine-containing polymer consists of:

(I) a repeat unit derived from a monomer having a fluoroalkyl group, which is a (meth)acrylate ester of the formula:

$$Rf\text{-}A\text{-}OCOCR^{11}{=}CH_2$$

wherein Rf is a fluoroalkyl group having 3 to 21 carbon atoms, $R^{11}$ is a hydrogen atom or a methyl group, and A is a linear or branched alkylene group having 1 to 20 carbon atoms, a $—SO_2N(R^{21})R^{22}—$ group or a $—CH_2CH(OR^{23})CH_2—$ group where $R^{21}$ is an alkyl group having 1 to 10 carbon atoms, $R^{22}$ is a linear or branched alkylene group having 1 to 10 carbon atoms, and $R^{23}$ is a hydrogen atom or a acyl group having 1 to 10 carbon atoms, (II) a repeat unit derived from a fluorine-free monomer, and (III) optionally present, a repeat unit derived from a crosslinkable monomer which is a fluorine-free vinyl monomer having at least two reactive groups.

8. A method of preparing a treated textile, comprising steps of:

(1) preparing a treatment liquid comprising a water- and oil-repellent agent, (2) adjusting pH of the treatment liquid to at most 7, (3) applying the treatment liquid to a textile, (4) subsequent to applying the treatment liquid, treating the textile with steam, and (5) washing the textile with water and dehydrating the textile, wherein the water- and oil-repellent agent comprises at least one fluorine-containing compound which is a fluorine-containing polymer, and the water- and oil-repellent agent or the treatment liquid contains an organic salt which is a monovalent metal salt of an organic acid, provided that the organic acid is at least one selected from the group consisting of formic acid, acetic acid, oxalic acid and phthalic acid when the monovalent metal is potassium, and that the organic acid is at least one selected from the group consisting of formic acid, oxalic acid and phthalic acid when the monovalent metal is sodium, the amount of the organic salt is from 10 to 500 parts by weight, per 1 part by weight (solid content) of the fluorine-containing compound, and the fluorine-containing polymer consists of:

(I) a repeat unit derived from a monomer having a fluoroalkyl group, which is a (meth)acrylate ester of the formula:

$$Rf\text{-}A\text{-}OCOCR^{11}{=}CH_2$$

wherein Rf is a fluoroalkyl group having 3 to 21 carbon atoms, $R^{11}$ is a hydrogen atom or a methyl group, and A is a linear or branched alkylene group having 1 to 20 carbon atoms, a $—SO_2N(R^{21})R^{22}—$ group or a $—CH(OR^{23})CH_2—$ group where $R^{21}$ is an alkyl group having 1 to 10 carbon atoms, $R^{22}$ is a linear or branched alkylene group having 1 to 10 carbon atoms, and $R^{23}$ is a hydrogen atom or a acyl group having 1 to 10 carbon atoms, (II) a repeat unit derived from a fluorine-free monomer, and (III) optionally present, a repeat unit derived from a crosslinkable monomer which is a fluorine-free vinyl monomer having at least two reactive groups.

9. The method according to claim 8, wherein pH of the treatment liquid is adjusted to at most 3 in the step (2).

10. The method according to claim 8, wherein the textile is a carpet.

11. The method according to claim 10, wherein the carpet comprises at least one of a nylon fiber, a polypropylene fiber and a polyester fiber.

* * * * *